United States Patent [19]

Lambot

[11] 4,187,919

[45] Feb. 12, 1980

[54] CABLE-TYPE CORE BARREL

[75] Inventor: Honore J. Lambot, Wauthier-Braine, Belgium

[73] Assignee: Diamant Boart, Brussels, Belgium

[21] Appl. No.: 902,603

[22] Filed: May 3, 1978

[30] Foreign Application Priority Data

May 3, 1977 [BE] Belgium ..... 177239

[51] Int. Cl.[2] ..... E21B 9/20

[52] U.S. Cl. ..... 175/246

[58] Field of Search ..... 175/246, 257, 309

[56] References Cited

U.S. PATENT DOCUMENTS

| | | | |
|---|---|---|---|
| 3,667,558 | 6/1972 | Lambot | 175/246 |
| 3,977,482 | 8/1976 | Reed | 175/246 |

*Primary Examiner*—William F. Pate, III

*Attorney, Agent, or Firm*—Sughrue, Rothwell, Mion, Zinn and Macpeak

[57] ABSTRACT

A cable-type core barrel comprising, within a set of outer tubes provided lowerly with a drill bit, an inner tube provided at its bottom with an extractor cone and at its top with a hooking head provided with an upper cone frustum hook and a release cone, the inner tube being lockable in the core boring position by a tongue latch supported by a tubular latch support which is rigid with the inner tube and does not affect the release of this latter. The core barrel is fitted with an inshot comprising a lower longitudinally slotted bell member connected to a rod extending upwards, an upper hooking head comprising an upper cone frustum hook and rigid with an intermediate tube extending downwards, a helical spring housed between the intermediate tube and the rod, and resting on supports on said intermediate tube and said rod, and a threaded ring which is screwed on to the intermediate tube and when in its lower position surrounds the bell member. The inshot is designed to cooperate with the latch support to lower the inner tube within the set of outer tubes.

9 Claims, 10 Drawing Figures

CABLE-TYPE CORE BARREL

BACKGROUND OF THE INVENTION

This invention relates to a cable-type core barrel.

Basically, the core barrel comprises an inner tube sliding in a set of outer tubes.

The set of outer tubes is provided lowerly with a drill bit, and comprises an annular suspension ledge for the inner tube, and an annular locking groove for the inner tube, located above the suspension ledge.

The inner tube carries an extractor cone at its bottom, and comprises at its top a hooking head provided with an upper cone frustum hook and a release cone. When in its lower core boring position, the inner tube rests against the aforesaid suspension ledge, and can then be locked relative to the set of outer tubes by means of a latch comprising tongues engaged in the said locking groove. The latch is supported by a tubular latch support which is rigid with the inner tube and which does not affect the release of said inner tube. The hooking head for the inner tube is rigid with a release slide which carries a release pin and which slides in the latch support and relative thereto. Furthermore, the inner tube can be released from its core boring position by the release slide, the release pin of which disengages the latch tongues from the locking groove, by means of traction exerted on the cone frustum hook of the inner tube hooking head.

THE PRIOR ART

In known core barrels of this type, the hoocking head for the inner tube comprises a downwardly flared cone frustum hook and a release cone situated below the cone frustum hook. In this respect, the cone frustum hook is the only element for hooking the inner tube to the overshot and suspending it therefrom. In this case, the inner tube is lowered before drilling and core boring, and is raised after these operations by each time being hooked to the overshot, which itself is suspended from the operating cable.

Thus, in known cases, the overshot constitutes the only device of the core barrel used for positioning and withdrawing the inner tube in the set of outer tubes.

In this respect, the known overshot comprises a lower clamp comprising opposing nose pieces which are resiliently urged towards its longitudinal axis, and is rigid with the body of said overshot. In addition, a longitudinally split ring surrounds the body of the overshot and can slide freely and axially relative to said body. The nose pieces of the clamp are displaced from the longitudinal axis of the overshot by their contact with the release cone of the hooking head of the inner tube. The said split ring then falls relative to the body and to the clamp of the overshot, and covers the tops of the nose pieces of said clamp so as to prevent them from closing again. The inner tube is then free from the overshot. Furthermore, the overshot comprises an upper hooking head which has only one cavity for housing the cable connector of said cable, this cavity containing a connection device for said cable connector. The overshot also generally comprises two parts assembled together by a safety pin which becomes sheared if the inner tube encounters any accidental high resistance when raised in the set of outer tubes.

Known core barrels of the said type have disadvantages.

Known core barrels prove particularly dangerous during the descent of the inner tube in the set of outer tubes when borring in a dry hole. In this respect, if the inner tube is braked or suddenly stopped during its descent before reaching its proper lower core boring position, in particular because of friction, air pressure or possible roughness at the connections between the outer tubes, the result is that the overshot descends relative to the inner tube. During this descent, the nose pieces of the lower clamp of the overshot rest on the release cone of the inner tube hooking head. Because of this, the nose pieces in question withdraw one from the other, and the split ring descends relative to the body of the overshot and thus covers the tops of the nose pieces. In this manner, said nose pieces are kept withdrawn from each other, and the inner tube is free from the overshot. Consequently, the inner tube can fall under free fall conditions to the bottom of the set of outer tubes, and this inevitably leads to its complete destruction.

In addition, known core barrels also show disadvantages when the inner tube is raised after core boring. In this respect, the safety pin which connects together the two parts of the known overshot is subjected to fatigue stresses during the displacement of the inner tube in the set of outer tubes. The result is that when in use, said safety pin which has been subjected to fatigue is able to resist smaller shear stresses then those which it was able to resist initially. Under such conditions, the safety pin becomes sheared prematurely, thus necessitating the needless and costly extraction of the set of outer tubes from the bore hole.

It should be noted that there are also other known cable-type core barrels, but of a different type from that according to the invention. In these other core barrels, the inner tube is released by means of a tubular release piece which surrounds the top of the inner tube and is rigid with the inner tube hooking head. The tubular release piece slides axially relative to the inner tube. When initiating the release of the inner tube, the traction exerted by the operating cable raises the hooking head and the tubular release piece without displacing the remaining part of the inner tube. As it is raised, the tubular release piece re-closes the latch tongues by acting inwards from the outside, so as to release the inner tube. Furthermore, the hooking head of the inner tube is axially hollow to allow a further hooking piece rigid with the inner tube to be mounted, and which extends upwards beyond the normal cone frustum hooking nose piece and comprises at its upper end a circumferential hooking groove.

In addition, in order to be able to lower the inner tube of said known core barrels in a dry hole without prematurely releasing the inner tube, an apparatus is provided comprising essentially an upper hooking head and a lower roller clamp. The hooking head is rigid with a tube extending downwards. The roller clamp is housed in the bottom of the said tube and is mounted on an axial rod resiliently supported by a support ring fixed to said tube.

During the cooperation between the aforesaid apparatus and the inner tube of the other known core barrels, the roller clamp surrounds the top of the hooking head of the inner tube, and the rollers of said clamp are engaged in the hooking groove of the hooking piece. During the release of the inner tube from said apparatus, the traction exerted in the operating cable causes the top of the roller clamp to rise and holds the lower part of said clamp in place, thus causing the rollers to withdraw outwards by the force of a spring held by the bottom of the clamp. In this case, the rollers of the clamp of this apparatus and the wall of the hooking groove of the hooking piece of the inner tube head make contact with each other only at a limited number of points. The apparatus in question is therefore coupled to the inner tube only over a very small cross-section. Such a coupling is necessarily delicate, unsafe and unreliable. Furthermore, as such coupling is made close to the longitudinal axis of the core barrel, the mechamical components which provide it, i.e. the rollers and the top of the hooking piece for the inner tube, are of necessity small and fragile. Moreover, as the coupling in question takes place inside the casing of the clamp of the said apparatus, it is impossible to know from the surface during the assembly operation, and in particular before the inner tube descends into the set of outer tubes, whether said assembly has been properly carried out. Finally, the roller clamp of said apparatus and the hooking head of the inner tube are particularly complicated because of the high number of constituent mechanical elements.

SUMMARY OF THE INVENTION

The object of the invention is a new core barrel by which the aforesaid disadvantages of known cases are overcome.

To this end, the new core barrel is equipped both with an overshot and an inshot.

The overshot comprises a lower clamp with nose pieces which are resiliently urged towards the axis of the set of outer tubes, and an upper hooking head with a circumferential hooking groove and comprising means for mounting a cable connector.

The inshot comprises a lower bell member longitudinally slotted to form radially flexible strips, the ends of which are provided with hooking projections. The bell member is connected mechanically to a rod or the like extending axially upwards. The inshot also comprises an upper hooking head with an upper cone frustum hook. The hooking head is rigid with an intermediate tube or the like which extends axially downwards about the axial rod connected to the lower bell member. In addition, a helical spring is housed in the intermediate tube about the axial rod and rests against an upper shoulder on said axial rod and a lower shoulder on said intermediate tube. The axial rod and intermediate tube can thus slide axially relative to each other, either with or against the helical spring. A threaded ring is screwed on to the intermediate tube and surrounds the flexible strips of the bell member to selectively prevent or allow their radial extension by flexion.

In this respect, the inner tube is lowered into the core boring position by being suspended either on the inshot alone or on the inshot which itself is suspended on the overshot. At the surface, the inshot is hooked on to the latch support of the inner tube by the flexible strips of its bell member, the lower projections of which are engaged in a circumferential hooking groove in said latch support. The flexible strips are then prevented from bending towards the set of outer tubes and releasing their hooking projections from the hooking groove in the latch support by means of the threaded ring which is then placed in the lower position. The overshot may then be hooked at the surface to the inshot by means of the nose pieces of its clamp hooking the cone frustum hook of the inshot hooking head.

When the inner tube is brought into the core boring position and locked, it is unhooked from the inshot by traction exerted upwards on the inshot, or on the overshot and then transmitted to the inshot. This traction firstly lifts the hooking head of the inshot together with the intermediate tube and threaded ring, without lifting the bell member and axial rod and compressing the helical spring. As the threated ring is raised it releases the flexible strips of the bell member, the lower projections of which are than in desengagement with the hooking groove of the latch support of the inner tube. In this manner, the inner tube becomes disengaged and the inshot is then lifted, either suspended from the operating cable or from the overshot, while leaving the inner tube in place.

Finally, the inner tube, provided with a core and released, is lifted from its core boring position by being suspended from the overshot, itself suspended from the inshot.

The overshot is hooked to the hooking head of the inner tube in the set of outer tubes by the nose pieces of its clamp hooking on to the cone frustum hook of said hooking head. At the surface, the inshot is previously hooked to the overshot by the flexible strips of its bell member, by engaging their lower projections in the hooking groove in the overshot hooking head. The lower projections on the flexible strips are prevented from disengaging from the hooking groove by then placing the threated ring in the lower position. During the lifting of the inner tube, the inshot does not cause any deformation of its helical spring which would be capable of disengaging its bell member from the overshot, except in the case of any accidental resitance to this lifting, in which case the inshot becomes disengaged from the overshot without breaking the operating cable.

In this manner, during the descent of the inner tube of the new core barrel, there is no risk of the overshot, which no longer comprises the split release ring, becoming disengaged from the elements suspended from it, while the inshot remains constantly hooked upperly to the overshot and lowerly to said inner tube even if there is any accidental stoppage of this latter above its lower core boring position. In other words, by means of the new core barrel, there is no longer any risk of the inner tube ceasing to be mechanically connected to the operating cable should it become temporarily blocked inside the set of outer tubes.

Furthermore, during the lifting of the inner tube of the new core barrel, as the overshot no longer comprises the safety pin there is no risk of rupturing said cable, the function of this pin now being performed more reliably and effectively by the inshot itself, which disengages from the overshot for a given and practically invariable limited traction force.

Preferably, in the new core barrel, the cone frustum hook of the inner tube hooking head and that of the inshot hooking head can be identical or similar, and the circumferential hooking groove in the latch support of the inner tube and that in the hooking head of the overshot can be identical or similar.

With regard to the constructional characteristics of the inshot of the new core barrel, said inshot comprises an upper hub, and the flexible strips are separated by longitudinal slots extending as far as the vicinity of said hub. When in the lower position, the threaded ring surrounds the flexible strips over a large part of their height. In addition, the hub of the bell member comprises a central aperture traversed by the axial rod, the lower enlarged end of which acts as a support for said hub, and the upper threaded end of which carries a washer retained by a nut and serving as an upper support for the helical spring surrounding said rod.

According to further constructional characteristics of the inshot of the new core barrel, the hooking head is mounted freely rotatable about its longitudinal axis. For this purpose, the lower threaded part of the hooking head carries an annular disc retained by a nut and serving as a support for a thrust bearing on which the upper collar of said intermediate tube rests.

In order to enable it to be easily constructed and assembled, the intermediate tube of the new core barrel inshot is constituted by two parts which can be screwed axially one into the other. The upper part comprises the aforesaid upper collar, and the lower part comprises a lower collar with a central aperture traversed by the axial rod and forming the lower shoulder for the helical spring.

To avoid rupturing the said operating cable, the helical spring of the new core barrel inshot is advantageously calibrated at about 10% of the elastic limit of the cable.

BRIEF DESCRIPTION OF THE DRAWINGS

Further details of the invention will be apparent from the description and accompanying drawings which show one embodiment thereof diagrammatically by way of example only.

In these various figures, the same reference numerals indicate identical elements.

DESCRIPTION OF THE PREFERRED EMBODIMENT

Figure 1:
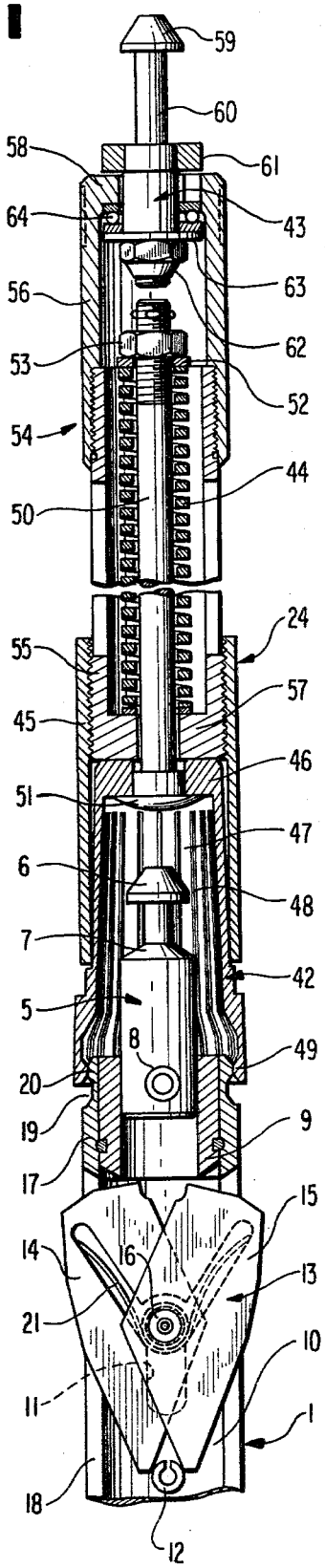
FIG. 1 is an axial section through the top of the inner tube of the new core barrel fitted with an inshot, as this latter is being mounted on the inner tube.
Figure 2:
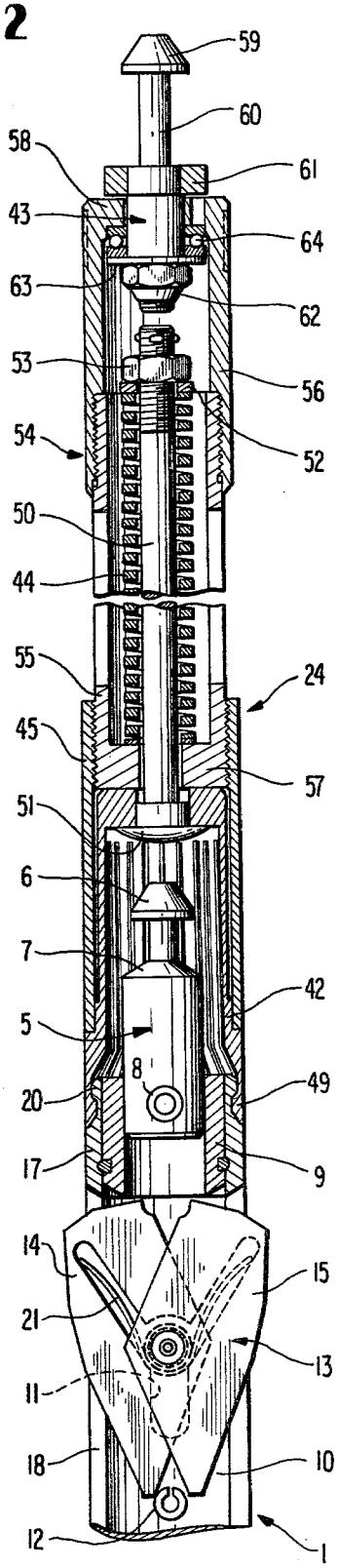
FIG. 2 is an analogous section but after mounting the inshot on the inner tube.
Figure 3:
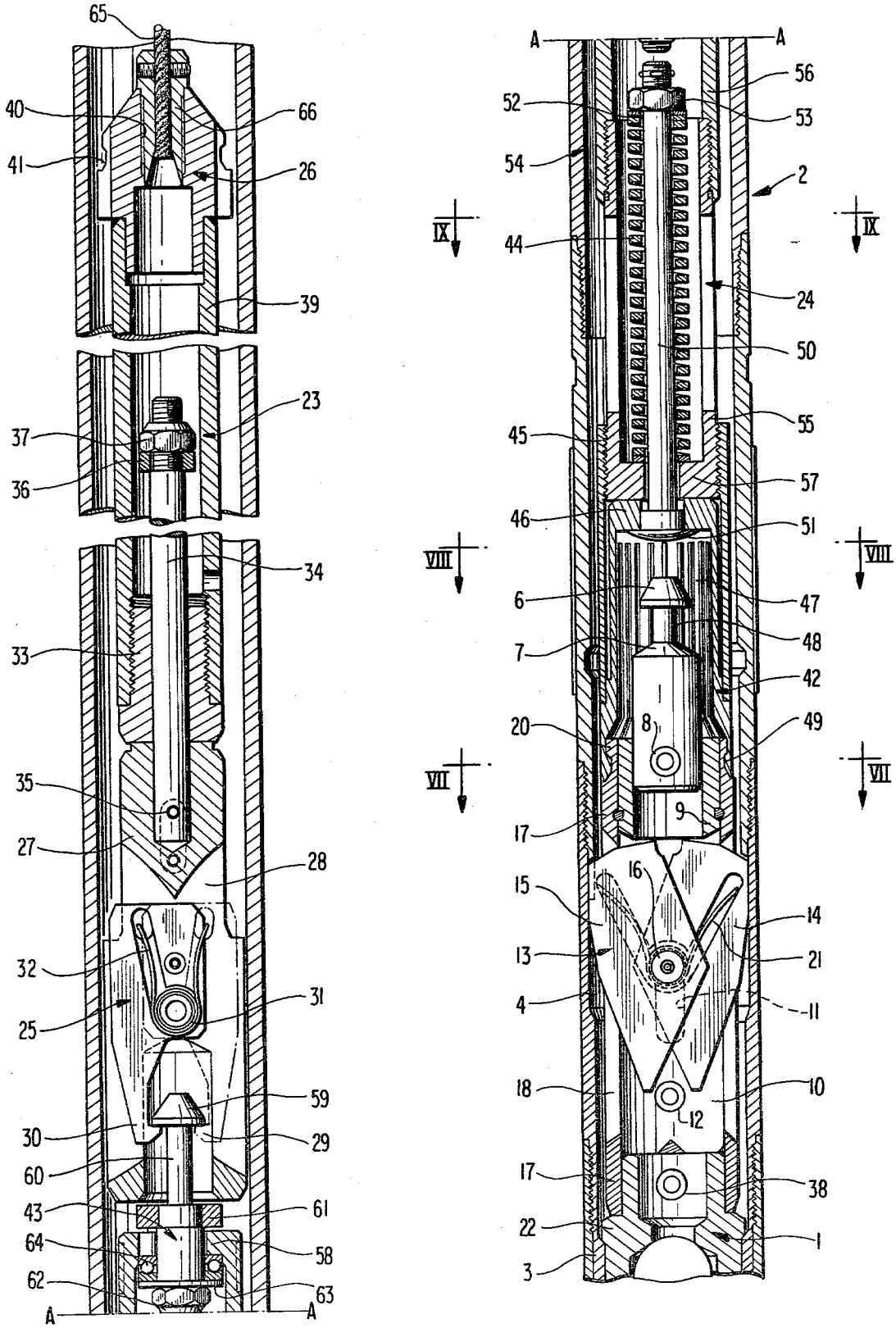
FIG. 3 is an axial section through the top of the inner tube suspended from the inshot, which is itself suspended from an overshot, as these elements are being lowered inside the set of outer tubes.
Figure 4:
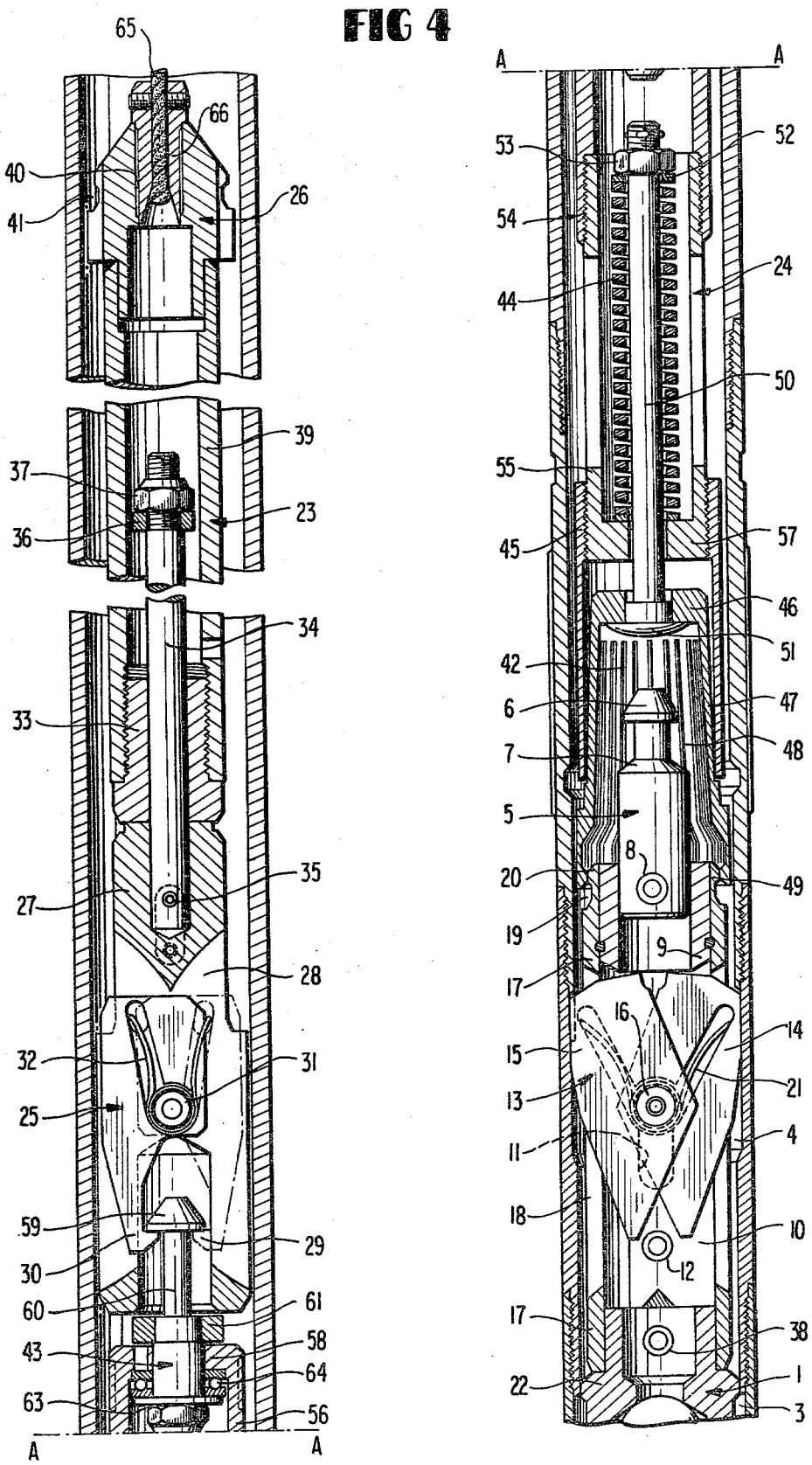
FIG. 4 is an axial section through the top of the inner tube, inshot and overshot, as the inshot is disengaging from the inner tube in the core boring position in the set of outer tubes.
Figure 5:
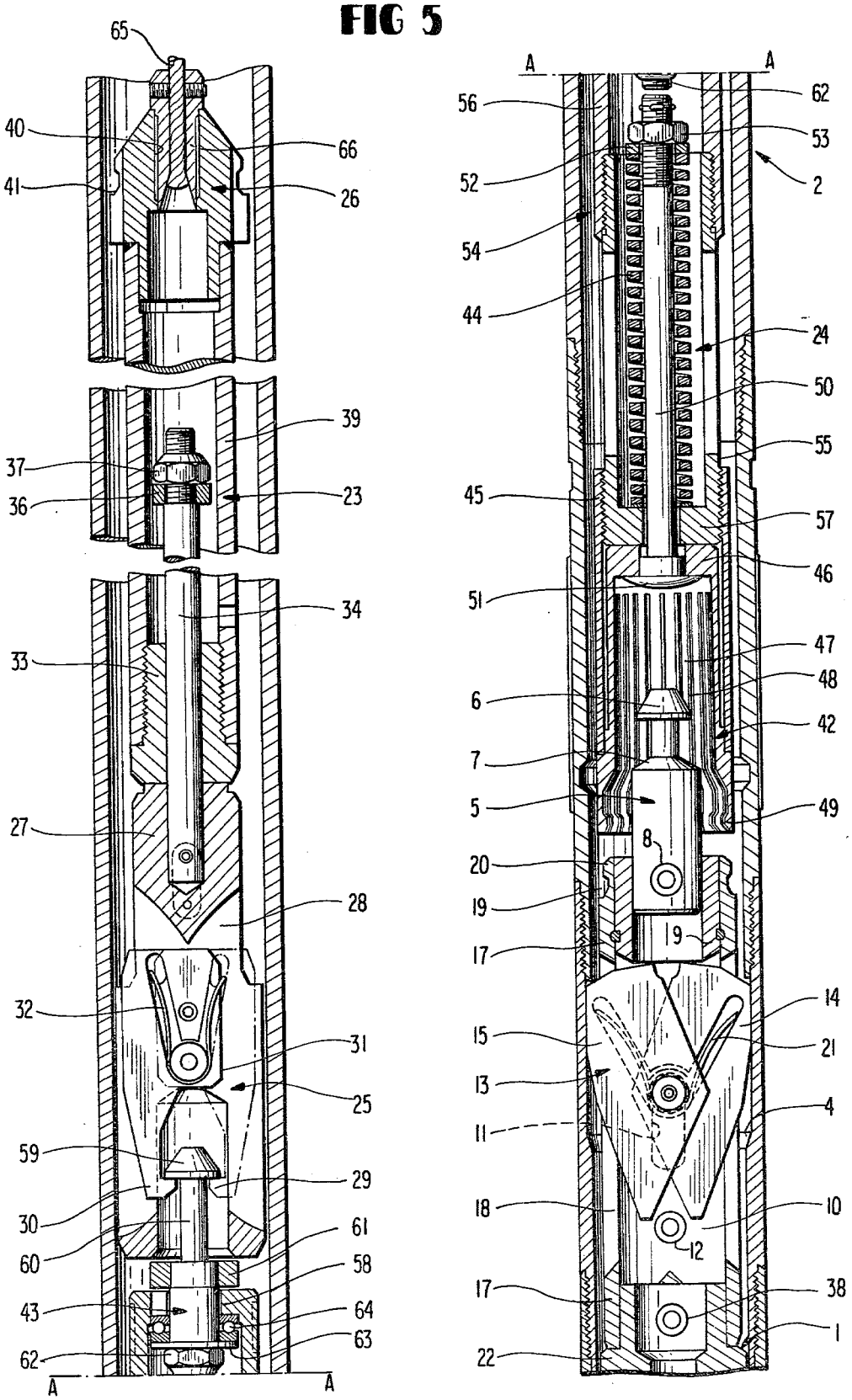
FIG. 5 is an axial section through the top of the inner tube, inshot and overshot, as the overshot and inshot are about to be lifted inside the set of outer tubes, said inshot having been released from the inner tube, which remains in the core boring position.
Figure 6:
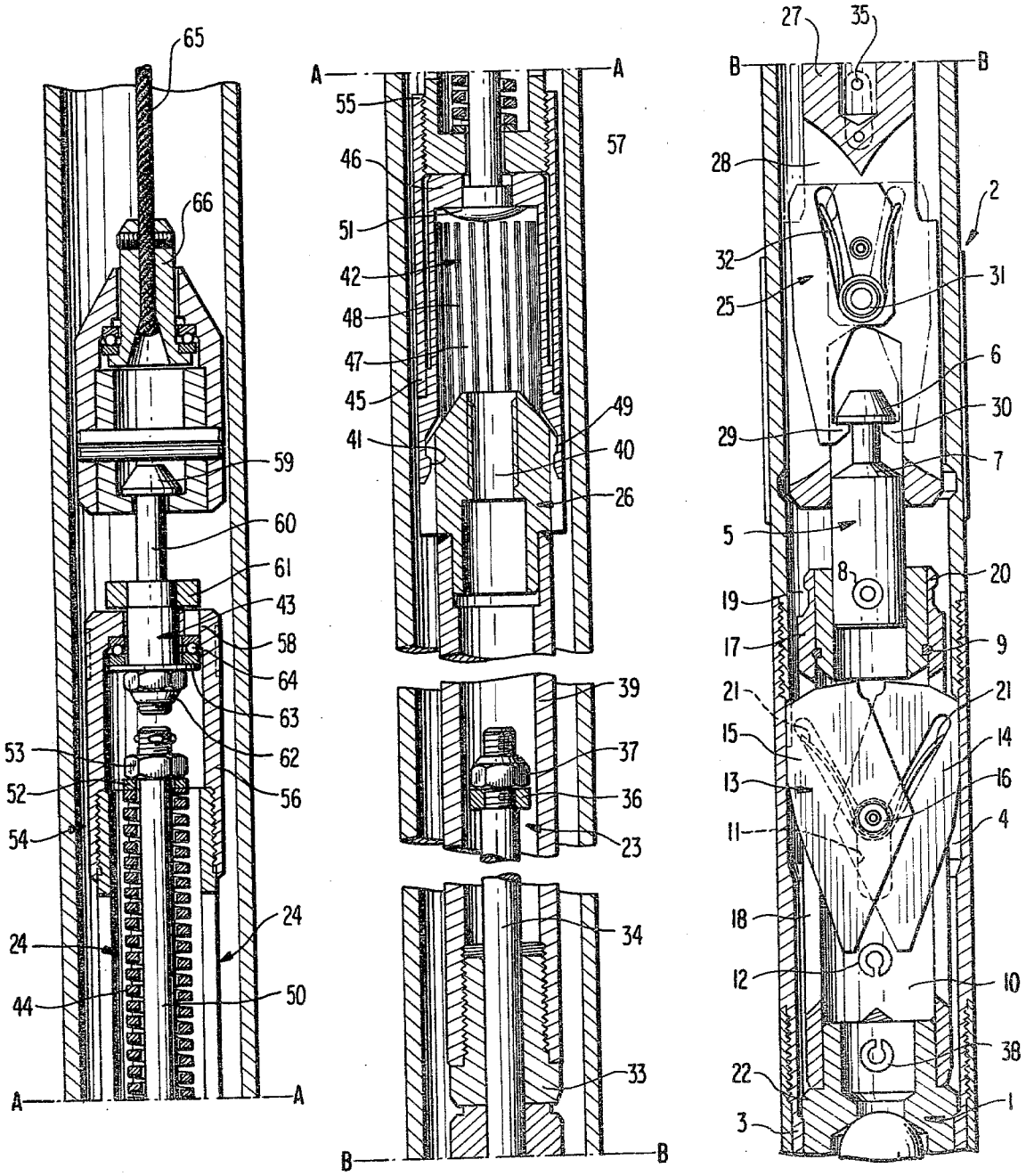
FIG. 6 is an axial section through the top of the inner tube, overshot and inshot as the inner tube is lifted inside the set of outer tubes, and reclaimed therefrom.
Figure 7:
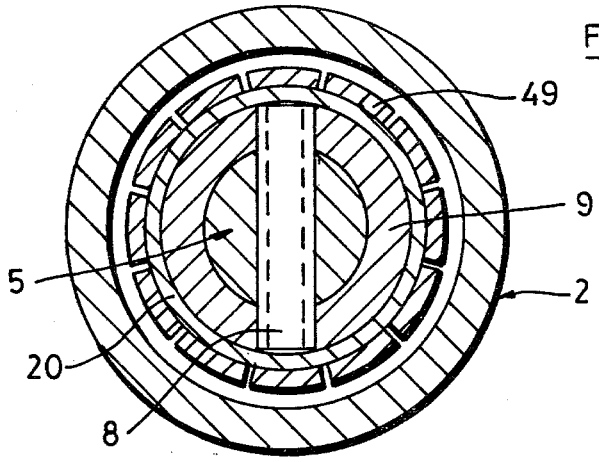
FIG. 7 is a cross section through the inshot on the line VII—VII of FIG. 3.
Figure 8:
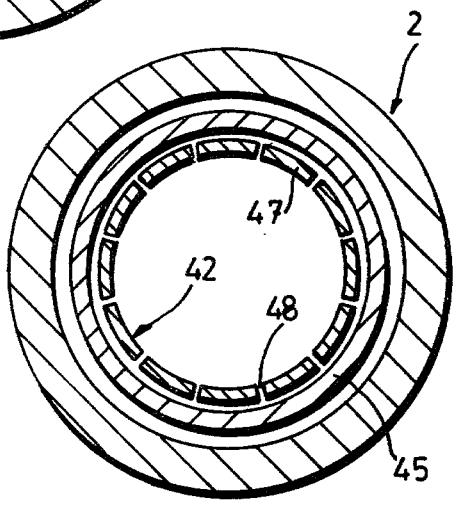
FIG. 8 is a cross-section through the inshot on the line VIII—VIII of FIG. 3.
Figure 9:
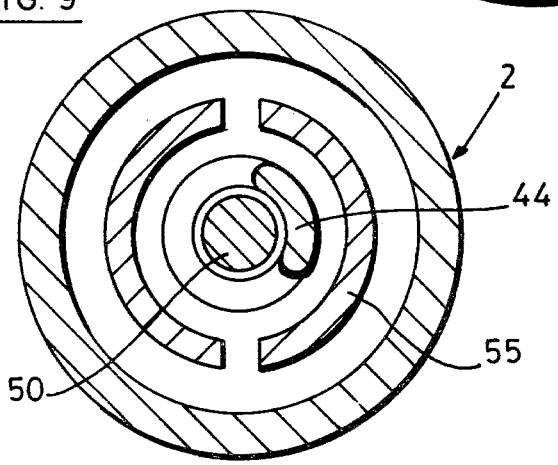
FIG. 9 is a cross-section through the inshot on the line IX—IX of FIG. 3.
Figure 10:
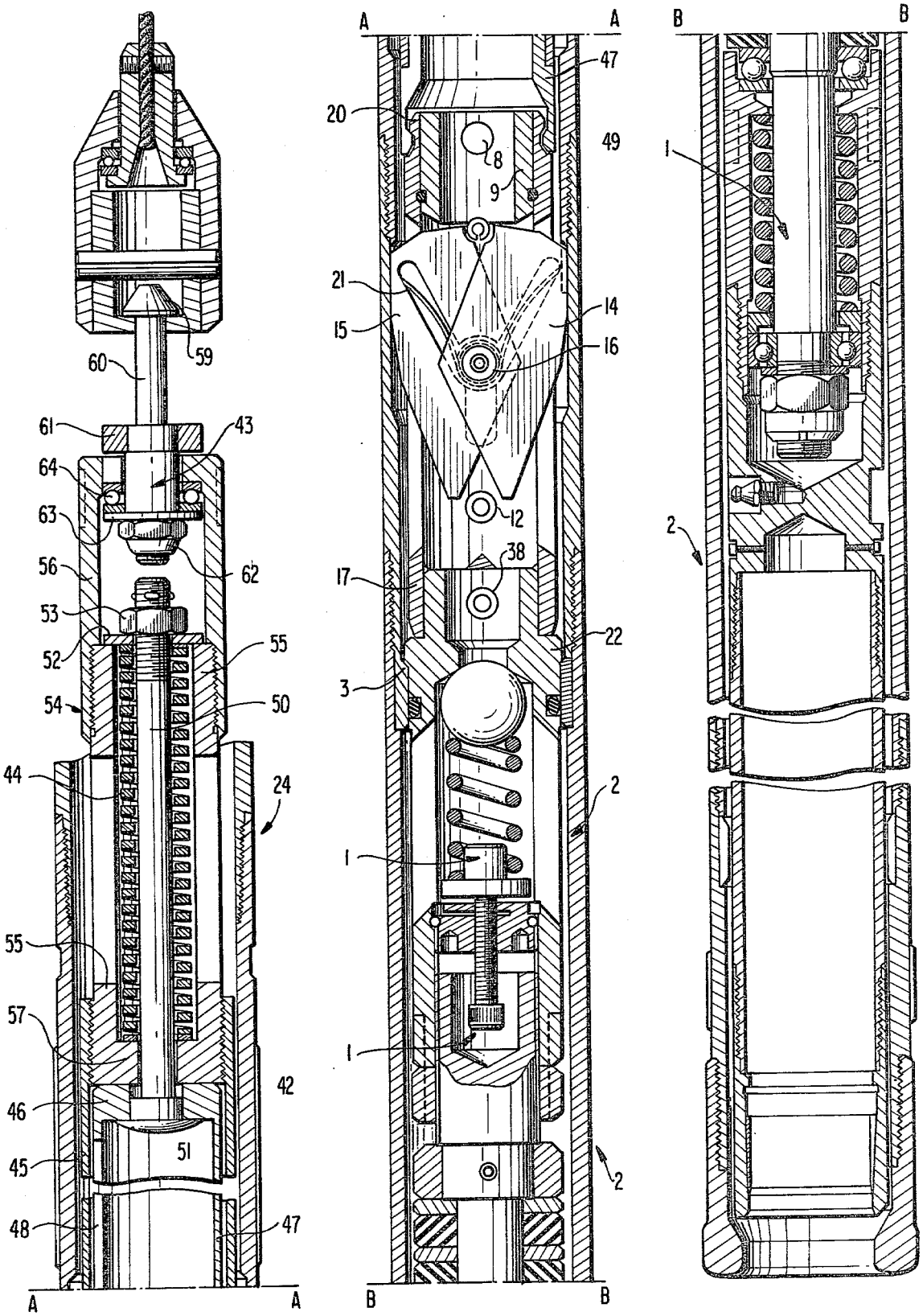
FIG. 10 is an axial section analogous to that of FIG. 3 and showing the inner tube which has descended suspended only from the inshot.

The core barrel represented is of the cable type, and is used for boring ground and withdrawing core samples therefrom for the analysis of the constituent rocks of the ground.

For purpose of boring, the core barrel comprises essentially an inner tube 1 and a set of outer tubes 2.

The set of outer tubes 2 comprises several coaxial tubes assembled one after the other and screwed one into the other at their adjacent ends. At its lower end, the set of outer tubes 2 comprises a diamond-equipped bit for drilling the ground from which the core is to be bored. At its upper end, the set of outer tubes 2 is driven by a motor which rotates it about its longitudinal axis to enable the bit to drill the ground from which the core is to be bored.

At a determined level, the set of outer tubes 2 comprises an annular suspension ledge 3 on which the inner tube 1 rests in its lower position for the core boring. Above the ledge 3, the set of outer tubes 2 comprises an annular locking groove 4 in which the inner tube 1 is locked in its lower boring position.

The inner tube 1, of known type, is an assembly of mechanical pieces by means of which the core formed during the drilling and core boring is held and lifted to the surface. The inner tube 1 thus slides axially inside the set of outer tubes 2. The inner tube 1 is lowered to the lower core boring position, in which it is locked to the set of outer tubes 2. The locking mechanism for the inner tube 1 turns together with the set of outer tubes 2 during the drilling and core boring. The inner tube 1 is lifted with a core to the surface after drilling and core boring.

The inner tube 1 is provided lowerly with an extractor cone which receives the core being formed and takes possession of the formed core by detaching it from the ground.

At its top, the inner tube 1 comprises a hooking head 5 constituted by a single piece comprising an upper cone frustum hook 6 and a release cone 7 disposed below the hook 6. The hooking head 5 is connected by a diametrical pin 8 to a release slide 9 which comprises a diametrical slot 10 and two diametrically opposing elongated apertures 11. The release slide 9 carries a release pin 12 extending diametrically across the slot 10 below the aperture 11. The release pin can slide relative to the remaining part of the inner tube 1.

The inner tube 1 also comprises a latch 13 constituted by two parallel flat release tongues 14 and 15 housed in the diametrical slot 10. The tongues 14 and 15 pivot together about a diametrical pivot 16 which traverses the aforesaid corresponding elongated apertures 11, and has its ends fixed to a tubular latch support 17. The latch support 17 comprises two diametrically opposing release slots 18 situated facing the diametrical slot 10. The latch support 17 comprises a circumferential hooking groove 19 on its outer face close to its upper end 20, which is chamfered. The latch support 17 is firmly connected to the remaining lower part of the inner tube 1 by a pin 38. The slide 9 can slide slightly relative to the latch support 17 because of the ability of the pivot 16 to slide in the said elongated apertures 11.

It should be noted that the tongues 14 and 15 of the latch 13 are constantly urged apart by a spring 21, away from the common longitudinal axis of the lower tube 1 and set of outer tubes 2.

As heretofore stated, when in its lower core boring position, the inner tube 1 is suspended in the set of outer tubes 2 by an annular rim 22 which rests on the suspension ledge 3. In this core boring position, the inner tube 1 is also locked to the set of outer tubes 2 by the tongues 14 and 15 engaged in the locking groove 4 through the slots 18, under the action of the spring 21.

The lower tube 1 is released from its lower core boring position by traction exerted on the cone frustum nose piece 6 of the hooking head 5. This traction firstly causes the hooking head 5 and release slide 9 to lift. When this lifting begins, the release pin 12 which is perpendicular to the tongues 14 and 15 comes into contact therewith so causing their top parts to approach the longitudinal axis of the core barrel and thus disengage said top parts from the locking groove 4. The latch 13 is thus closed, and the inner tube 1 can be moved upwards to the surface.

The core barrel is fitted both with an overshot 23 and an inshot 24, to enable the inner tube 1 to be moved vertically in the set of outer tubes 2.

Basically, the overshot 23 comprises a lower clamp 25 and an upper hooking head 26.

The clamp 25 is mounted in a body 27, and is disposed in a diametrical slot 28 in the body 27. The clamp 25 is constituted by two nose pieces 29 and 30 in the form of flat parallel plates, cut out in any appropriate manner. The nose pieces 29 and 30 pointing towards the longitudinal axis of the core barrel pivot about a pivot 31 fixed to the two parts of the body 27 which laterally define the diametrical slots 28. Furthermore, the nose pieces 29 and 30 are urged constantly to approach each other at their lower ends by a spring 32 which surrounds the pivot 31 and is applied at its ends to the upper parts of the nose pieces 29 and 30.

The body 27 of the overshot 23 is surmounted by a sleeve 33 and connected to an axial assembly rod 34 which traverses the bore in this latter. The lower part of the rod 34 comprises a transverse hole traversed by a pin 35 inserted into two coaxial holes in the body 27. The top of the rod 34 is provided with a nut 36 and locking nut 37 positioned in such a manner as to enable the sleeve 33 to slide about the rod 34 so that the sleeve 33 strikes the body 27 at the time of the recovery, in order to facilitate the hooking of the nose pieces 29 and 30 of the clamp 25 on to the cone frustum hook 6 of the hooking head 5. A tube 39 with its bottom threaded is screwed on to the externally threaded sleeve 33. The tube 39, which extends upwards about and beyond the rod 34, carries the hooking head 26 welded to its upper edge.

The hooking head 26 has its upper face chamfered and is flared downwards. The hooking head 26 comprises both a transverse central slot 40 and a circumferential hooking groove 41 located on its lateral face and at the base of its upper face. The hooking grooves 19 and 41 are preferably identical or at least similar.

Basically, the inshot 24 comprises a lower slotted bell member 42, an upper hooking head 43, a helical spring 44 and a threated ring 45.

The bell member 42 is constituted by an upper hub 46 with a central circular aperture, and flexible strips 47 which extend downwards and are separated from each other by longitudinal slots 48. In the described example, the longitudinal slots 48 extend from the lower ends of the strips 47 to the vicinity of the hub 46.

The lower end of each of the strips 47 is provided with a hooking projection 49 directed towards the longitudinal axis of the core barrel. The shape of the projections 49 corresponds to the profile of the hooking groove 41 of the hooking head 26 of the overshot 23, and also to the profile of the hooking groove 19 of the latch support 16.

In the inshot 24, the bell member 42 is supported by an axial rod 50 which traverses the central aperture in the hub 46 and extends upwards beyond the hub 46. The lower end of the rod 50 is upset to form a support 51 on which the hub 46 of the bell member 42 rests. The upper threaded end of the rod 50 carries a washer 52 retained by a nut 53.

In the inshot 24, the axial rod 50 is connected to the hooking head 43 by the helical spring 44 and by an intermediate tube 54. In the case described, the intermediate tube 54 comprises two parts constituted respectively by a lower tubular element 55 and an upper tubular element 56 screwed one into the other at their adjacent ends.

The lower tubular element 55 comprises a lower collar 57 permanently traversed by the axial rod 50.

The helical spring 44 which surrounds the axial rod 50 rests at one end against the washer 52 which serves as the upper support, and at the other end against the said collar 57 which is used as the lower support. In its free state, the helical spring 44 pushes the lower collar 57 of the lower tubular element 55 against the hub 46 of the bell member 42.

The outer lateral face of the lower tubular element 55 is threaded, at least at its bottom part. The said threaded ring 45 is screwed on to this threaded face. In this manner, the axial or longitudinal position of the threaded ring 45 along the lower tubular element 55 is adjustable. In its lower position, the threaded ring 45 surrounds the flexible strips 47 over a large part of their height. In its raised position, the threaded ring 45 surrounds much less of the flexible strips 47, which can then bend and expand radially under the action of their own elasticity.

The upper tubular element 56 also comprises an upper collar 58 by which it is connected mechanically to the hooking head 43. In this respect, the hooking head 43 comprises essentially an upper cone frustum hook 59 which is flared downwards and is prolonged by an axial rod 60. The rod 60 comprises a rib 61 at its mid height, and at its lower threaded end it carries a nut 62 which retains an annular disc 63. A thrust bearing 64 is mounted about the rod 60 between the disc 63 and upper collar 58. In this manner, the intermediate tube 54 is supported by the hooking head 43, while being able to turn freely about the longitudinal axis of the core barrel.

It should be noted that because of the helical spring 44, the intermediate tube 54 can slide relative to the axial rod 50, and thus the hooking head 43 can be withdrawn from or made to approach the bell member 42. Furthermore, as the intermediate tube 54 slides relative to the axial rod 50, the threaded ring 45, which is rigid with the lower tubular element 55, follows the displacement of the intermediate tube 54 and thus consequently slides along the flexible strips 47 of the bell member 42.

Preferably, the cone frustum hook 59 of the hooking head 43 of the inshot is identical with the cone frustum hook 6 of the hooking head 5 of the inner tube 1. However, the hook 59 can be similar to the hook 6.

The inner tube 1 is moved within the set of outer tubes 2 by being suspended from the operating cable by way of the overshot 23 and inshot 24.

As it descends within the set of outer tubes 2, the inner tube 1 is suspended from the inshot 24, which itself is suspended from the overshot 23.

This is provided for at the surface by connecting the inshot 24 to the inner tube 1 and the overshot 23 to the inshot 24.

In order to dispose the inshot 24 on the inner tube 1, the threaded ring 45 is previously raised so as to cause the flexible strips 47 to become displaced to a maximum amount from the longitudinal axis of the inshot. The bell member 42 is then fitted on to the hooking head 5 and on to the latch support 17 of the inner tube 1. The lower projections 49 on the flexible strips 47 are thus brought opposite the hooking groove 19 of the latch support 17. The threaded ring 45 is then screwed downwards along the lower tubular element 55 so that the ring 45 assumes its lower position in which it clamps the flexible strips 47 against the top of the latch support 17 and the lower projections 49 in the hooking groove 19. In this manner, the bell member 42 of the inshot 24 becomes hooked to the latch support 17 of the inner tube 1.

The clamp 25 of the overshot is then hooked to the hooking head 43 of the inshot. For this purpose, the overshot 23 is lowered axially on to the inshot 24 to bring the nose pieces 28 and 29 against the cone frustum hook 59. The nose pieces 28 and 29 then withdraw one from the other against the spring 32, after which they suddenly approach each other aided by the spring 32 as soon as they have passed the cone frustum hook 59, to which they thus become hooked.

The overshot 23 is then suspended from the operating cable 65. For this purpose, the cable is provided with a conventional cable connector 66 which is inserted into the central slot 40 in the hooking head 26 of the overshot 23, and is connected to the hooking head 26 in a normal manner.

The inner tube 1, inshot 24 and overshot 23 can now be lowered within the set of outer tubes 2.

As stated heretofore, when it reaches the vicinity of its lower core boring position, the inner tube 1 becomes locked to the set of outer tubes 2 by the tongues 14 and 15 of its latch 13, which penetrate into the said locking groove 4. The latch support 17 then remains in place while the hooking head 5 and release slide 9 descend a little more until they abut against the remaining part of the inner tube 1.

Traction is now exerted on the operating cable 65, this traction being transmitted firstly to the overshot 23 and then to the inshot 24. Under the effect of this traction, the hooking head 43, intermediate tube 54 and threaded ring 45 of the inshot 24 are lifted and the helical spring 44 is compressed, but without displacing the axial rod 50 and the bell member 42. As the threaded ring 45 is lifted, the flexible strips 47 bend radially towards the set of outer tubes 2, and the lower projections 49 disengage from the said hooking groove 19. Because of this, the inshot 24 becomes unhooked from the latch support 17 of the inner tube 1. Consequently, the overshot 23 and inshot 24 which remain suspended from the operating cable 65 can be lifted, whereas the inner tube 1 is left in its lower core boring position.

After forming the core to be withdrawn, the inner tube 1 is raised within the set of outer tubes 2 by connecting the inner tube 1 to the overshot 23, and connecting the overshot 23 to the inshot 24 which is suspended from the operating cable 65.

For this purpose, the inshot 24 is hooked on the surface to the operating cable 65 by way of a conventional clamp 67 which hooks on to the cone frustum hook 59 of the said hooking head 43. The flexible strips 47 of the bell member 42 of the inshot 23 are then hooked to the hooking head 26 of the overshot 23. In order to do this, the threaded ring 45 is firstly raised to displace the flexible strips 47 from the longitudinal axis of the inshot, the bell member 42 is then fitted on to the hooking head 26, the threaded ring 45 is lowered into its lower position in order to move the strips 47 towards said axis and clamp the lower projections 49 in the hooking groove 41 of the hooking head 26.

Then after suspending the inshot 24 from the operating cable 65 and the overshot 23 from the inshot 24, the assembly of these elements is lowered within the set of outer tubes 2 so as to be able to recover the inner tube 1 after having released it. When the overshot 23 reaches the inner tube 1, the nose pieces 28 and 29 of its lower clamp 25 cooperate with the cone frustum hook 6 of the hooking head 5 to become disposed under said hook 6 and thus become hooked thereto.

Then by exerting a slight traction on the operating cable 65, the inshot 24, overshot 23 and inner tube 1 are firstly raised without unhooking the bell member 42 from the hooking head 26. The hooking head 5 and release slide 9 of the inner tube 1 are thus lifted, and by this means the release pin 12 is brought between the lower parts of the tongues 14 and 15 of the latch 13 so as to disengage said tongues from the locking groove 4 in the set of outer tubes 2. Thus the inner tube 1 is released, and can be raised to the surface while remaining suspended from the overshot 23, which itself is suspended from the inshot 24.

The inner tube 1 is halted during its rise only if it encounters a very high accidental resistance. At such a moment, the inshot operates as if disengaging from the inner tube when in its lower core boring position. In other words, the hooking head 43, the intermediate tube 54 and the threaded ring 45 continue to rise while the bell member 42 and axial rod 50 stop and the helical spring 44 becomes compressed. The result is that the flexible strips 47 expand radially outwards, and the bell member 42 and hooking head 26 become unhooked from each other without breaking the cable 65.

It is obvious that the inshot 24, which constitutes the essential new element of the invention, can be used to move not only the inner tube 1 within the set of outer tubes 2, but any other apparatus which can become jammed during its descent, in particular an apparatus for checking deviation, radioactivity or imperviousness of the grond.

As shown in the last figure, the inner tube 1 can also be lowered into its lower core boring position in the set of outer tubes 2 by being suspended only from the inshot 24, which itself is connected directly to the operating cable 65. The inshot 24 is mounted on to the latch support 17 of the inner tube 1 at the surface in the same manner as in the aforesaid case in which the inshot 24 is suspended from the overshot 23.

It is apparent that the invention is not limited exclusively to the embodiment shown, and modifications may be made to the shape, arrangement and constitution of certain of the elements of its construction, on condition that these modifications are not in contradiction with the scope of any of the following claims.

I claim:

1. A cable-type core barrel comprising:

a set of outer tubes, a drilling bit provided on the lower end of the set of outer tubes, an annular suspension ledge provided on the set of outer tubes, an annular locking groove provided on the set of outer tubes, an inner tube, an extractor cone provided at the lower end of the inner tube, an annular rim provided on the inner tube and bearing against the annular suspension ledge in a lower boring position of said inner tube, a hooking head provided at the upper end of the inner tube, an upper cone frustum provided on the hooking head, a release cone provided on the hooking head, a latch with tongues provided on the inner tube for locking it in the set of outer tubes by engaging said tongues in the annular locking groove, a tubular latch support for carrying the latch, said latch support being rigid with the inner tube and having no effect on the release of said inner tube, a release slide provided rigid on the hooking head, a release pin provided on the release slide and sliding in the latch support and relative thereto, said release pin disengaging the latch tongues from the annular locking groove by the effect of traction exerted on the cone frustum hook of the hooking head, an operating cable, an overshot comprising:

a lower clamp comprising nose pieces which are urged resiliently towards the axis of the set of outer tubes, and upper hooking head provided with a circumferential hooking groove and comprising mounting means for a cable connector, an inshot comprising:

a lower bell member slotted longitudinally to form radially flexible strips, the ends of which are provided with hooking projections, the bell member being mechanically connected to a rod or the like extending axially upwards, an upper hooking head comprising an upper cone frustum hook, the hooking head being rigid with an intermediate tube or the like which extends axially downwards about the axial rod connected to the lower bell member, a helical spring housed in the intermediate tube about the axial rod and resting against an upper support provided on the axial rod and a lower support provided on the intermediate tube, the axial rod and intermediate tube being thus able to slide axially relative to each other both with and against the helical spring, and a threaded ring screwed on to the intermediate tube and surrounding the flexible strips of the bell member to selectively prevent or allow their radial extension by bending, the inner tube being lowered into the core boring position by being suspended from the inshot alone or from the inshot which itself is suspended from the overshot, the inshot being hooked at the surface to the latch support of the inner tube by means of the flexible strips of its bell member, the lower projections of which are engaged in a circumferential hooking groove in the latch support, said flexible strips then being prevented from bending towards the set of outer tubes and releasing their hooking projections from the latch support because of the threaded ring disposed in its lower position, the overshot being hooked at the surface to the inshot by means of the nose pieces and its clamp, which hook onto the cone frustum hook of the hooking head of the inshot, the inner tube, when brought into the core boring position and locked therein, being released from the overshot by traction exerted upwards on the inshot, or on the inshot and the overshot and thus transmitted to the inshot, said traction firstly lifting the hooking head from the inshot together with the intermediate tube and threaded ring without lifting the bell member and axial rod and compressing the helical spring, the threaded ring on being raised releasing the flexible strips of the bell member, the lower projections of which disengage from the hooking groove of the latch support, while not affecting the release, so as to cause the inner tube to disengage and the inshot to be subsequently raised while remaining suspended from the operating cable or from the overshot, while leaving the inner tube in place, the inner tube, when provided with a core and released, being raised from its core boring position by being suspended from the overshot which is itself suspended from the inshot, the overshot being hooked inside the set of outer tubes to the hooking head of the inner tube by means of the nose pieces and of its clamp, which are hooked onto the cone frustum hook of the hooking head of the inner tube, the inshot being previously hooked at the surface to the overshot by the flexible strips of its bell member, the lower projections of which are engaged in the hooking groove in the hooking head of the overshot, said flexible strips then being prevented from releasing their lower projections from the hooking groove by the threaded ring which is then placed in its lower position, the inshot not causing its helical spring to deform to any extent capable of releasing its bell member from the overshot during the lifting of the inner tube except in the case of accidental resistance to said lifting, in which case the inshot disengages from the overshot without breaking the operating cable.

2. A core barrel as claimed in claim 1, wherein the cone frustum hook of the hooking head of the inner tube and that of the hooking head of the inshot are identical.

3. A core barrel as claimed in claim 1 or 2, wherein the circumferential hooking groove on the latch support of the inner tube and that on the hooking head of the overshot are identical.

4. A core barrel as claimed in claims 1 or 2, wherein the lower bell member of the inshot comprises an upper hub and flexible strips which are separated by longitudinal slots extending as far the vicinity of said hub, the threaded ring surrounding the flexible strips over a large part of their height when in its lower position.

5. A core barrel as claimed in claim 4, wherein the hub of the lower bell member of the inshot comprises a central aperture traversed by the axial rod, the lower enlarged end of which serves as a support for the hub, and the upper threaded end of which carries a washer retained by a nut and serving as an upper support for the helical spring which surrounds said axial rod.

6. A core barrel as claimed in claims 1 or 2, wherein the hooking head of the inshot is mounted freely rotatable about its longitudinal axis.

7. A core barrel as claimed in claim 6, wherein the lower threaded end of the hooking head of the inshot carries an annular disc retained by a nut and serving as a support for a thrust bearing on which rests the upper collar of the intermediate tube which surrounds the helical spring and axial rod.

8. A core barrel as claimed in claim 7, wherein the intermediate tube of the hooking head of the inshot is constituted by two parts which can be screwed axially one into the other, the upper part comprising the aforesaid upper collar, and the lower part comprising a lower collar provided with a central aperture traversed by the axial rod and forming the lower support for the helical spring.

9. A core barrel as claimed in claims 1 or 2, wherein the helical spring of the inshot is calibrated at about 10% of the elastic limit of the operating cable.

* * * * *